United States Patent [19]

Krzanowsky

[11] Patent Number: 4,602,717

[45] Date of Patent: Jul. 29, 1986

[54] UNCOUPLING LEVER ASSEMBLY

[75] Inventor: Nicholas Krzanowsky, Crown Point, Ind.

[73] Assignee: Stanrail Corporation, Hammond, Ind.

[21] Appl. No.: 692,977

[22] Filed: Jan. 22, 1985

[51] Int. Cl.[4] ..... B61G 3/08

[52] U.S. Cl. ..... 213/162; 213/211

[58] Field of Search ..... 213/152, 160, 162, 166–171, 213/211, 219; 308/3 R

[56] References Cited

U.S. PATENT DOCUMENTS

| | | | |
|---|---|---|---|
| 3,933,252 | 1/1976 | Murphy et al. | 213/166 |
| 4,010,854 | 3/1977 | Manyek | 213/166 |
| 4,378,890 | 4/1983 | Empson | 213/166 |
| 4,452,345 | 6/1984 | Mathieu | 308/3 R |
| 4,454,953 | 6/1984 | Chierici | 213/162 |
| 4,460,099 | 7/1984 | Empson | 213/166 |

FOREIGN PATENT DOCUMENTS

| | | | |
|---|---|---|---|
| 1003366 | 1/1977 | Canada | 213/162 |

*Primary Examiner*—David A. Scherbel
*Assistant Examiner*—Dennis C. Rodgers
*Attorney, Agent, or Firm*—Kinzer, Plyer, Dorn & McEachran

[57] ABSTRACT

An uncoupling lever assembly for a railroad car has first and second lever members. A plurality of sleeves are attached to one of the lever members. The other lever member extends through the sleeves in telescoping relation to the one member. Each sleeve is lined by a pair of oppositely-disposed, generally L-shaped glide members. Each glide member has a base with flexible hooks engaging a portion of the sleeve. An integral leg extends from the base and lies next to an adjacent portion of the sleeve.

5 Claims, 6 Drawing Figures

UNCOUPLING LEVER ASSEMBLY

SUMMARY OF THE INVENTION

This invention relates to an uncoupling lever assembly for a railroad car. The invention is particularly directed to a bearing pad or glide member for lining the sleeves of an uncoupling lever.

A primary object of the invention is an improved glide member for lining the sleeves of an uncoupling lever assembly.

Another object of the invention is a glide member of the type described which has a snap-in design which does not require mechanical fasteners to lock the glide members in the sleeve.

Another object of the invention is a liner for an uncoupling lever sleeve comprising a pair of L-shaped glide members.

A further object is a glide member of the type described which can be inserted into the sleeves after the sleeves have been attached to the uncoupling device.

Still another object of the invention is a glide member of the type described in which a pair of L-shaped glides are used in each sleeve producing a rectangular, hollow opening at each of the sleeves.

Yet another object of the invention is a sleeve liner of the type described having two L-shaped glide members which are slightly separated to form gaps between them. The gaps allow dirt, ice or debris to fall through the gaps and not become trapped between the glide members and the uncoupling members.

Yet another object of the invention is a glide member of the type described which can be hand assembled.

A further object of the invention is a pair of glide members of the type described which fully enclose the uncoupling lever members to allow turning torque to be transmitted from the handle to the lock lifter due to the four-sided holding feature of the glide members.

Other objects will become apparent in the following specification, drawings and claims.

DETAILED DESCRIPTION OF THE INVENTION

Figures 1, 2, 3, 4, 5, 6:
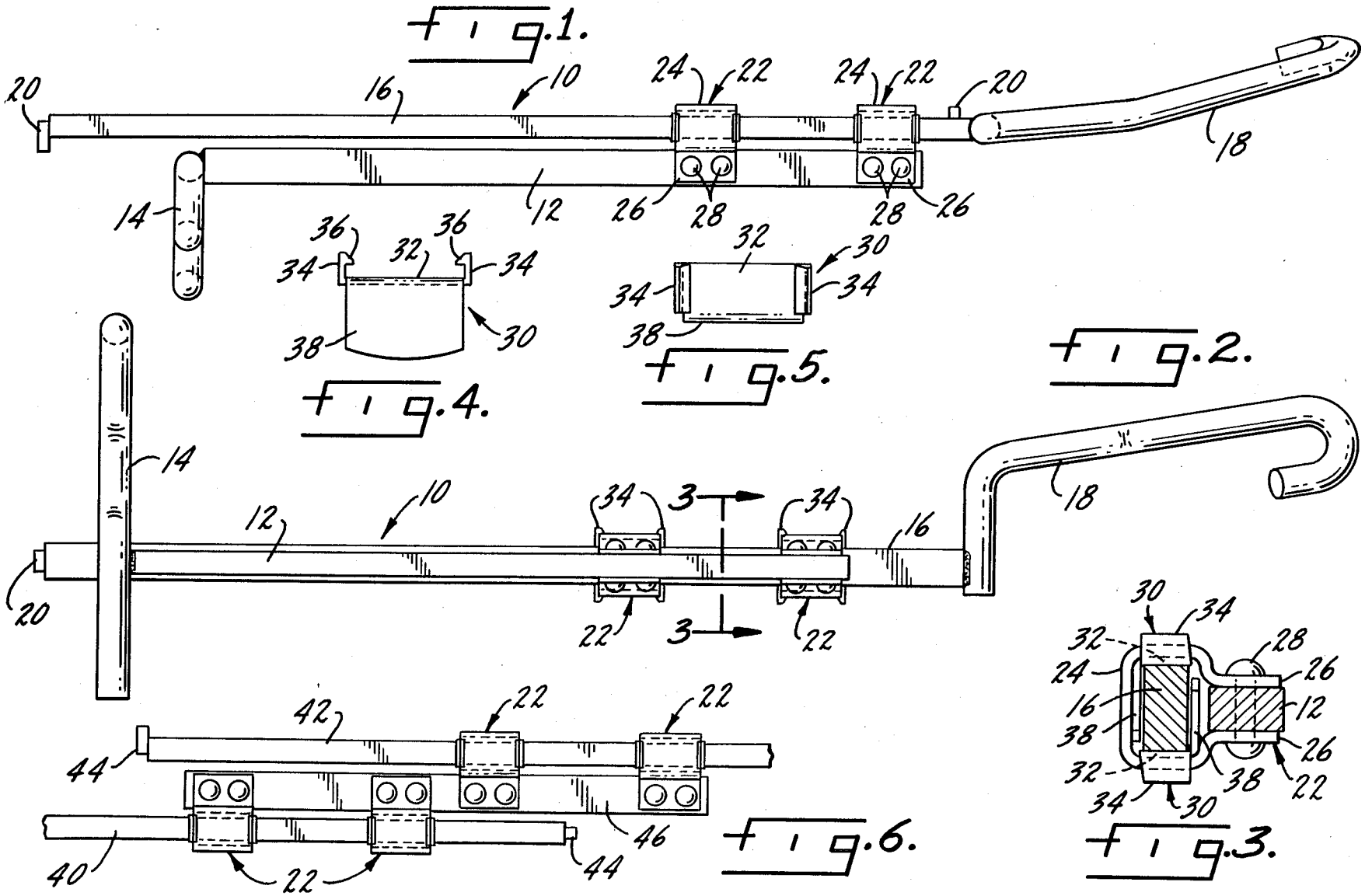
FIG. 1 is a plan view of an uncoupling lever assembly according to the present invention.
FIG. 2 is a front elevation view of the uncoupling lever assembly of FIG. 1.
FIG. 3 is a section taken along line 3—3 of FIG. 2 with background omitted for clarity.
FIG. 4 is a side elevation view of one of the glide members of the present invention.
FIG. 5 is a plan view of a glide member.
FIG. 6 is a plan view, with portions removed, of an alternate form of uncoupling lever using the glide members of the present invention.

FIGS. 1-3 show an uncoupling lever assembly 10 for a railroad car. The uncoupling lever includes a first lever member 12 having a handle portion 14. A second lever member 16 has a lock lifter portion 18 attached to one end and stops 20 attached to either end. A plurality of sleeves shown generally at 22 are attached to one of the lever members, in this case the first lever member 12. The second lever member 16 extends through the sleeves 22 in telescoping relation to the first lever member 12.

Details of the sleeve 22 are shown in FIG. 3. The sleeve includes a generally rectangular enclosure 24 which has a top, a bottom, a closed side and an open side. The open side is defined by a pair of flanges 26 which cooperate with the lever member 12 to complete the open side of the sleeve and fully enclose the second lever member 16. The flanges 26 engage substantially the full width of the lever member 12. They are rigidly fastened thereto by rivets or bolts or the like, shown at 28.

The enclosure 24 of each sleeve is lined by a pair of oppositely-disposed, generally L-shaped glide members 30. As seen in FIGS. 3-5, each glide member 30 has a base 32 engaging a portion of the sleeve as seen in FIG. 3. One of the glide members has a base engaging the top of enclosure 24 and the other glide member base engages the bottom of the enclosure. A pair of flexible hooks 34 extend along the edges of the base 32 and outwardly therefrom. Each hook has a finger 36 (FIG. 4) which engages the outer surface of the enclosure 24. This structure provides a flexible, snap-in design for the glide member 30. The glide member can be installed by hand after the sleeve has been fastened to the lever member. When installed, the top or bottom of the enclosure 24 will be disposed between the base 32 and the fingers 36 of hooks 34.

Each glide member 30 further includes an integral leg 38 extending from one edge of the base 32, in a direction opposite from the hooks 34. In the embodiment shown the leg extends at substantially a right angle to the base. When the glide member is installed the legs 38 will lie next to the sides of the enclosure 24. As can be seen in FIG. 3, the legs 38 and bases 32 fully encompass the second lever member 16. There are, however, slight gaps between the base of one glide member and the leg of the opposing glide member. These gaps are desirable since any dirt or ice can fall through the gaps and not become trapped between the glide members and the lever members. It will also be noted that the rectangular enclosure of the guide members about the lever member provides an efficient transfer of the turning torque and prevents twisting of one lever member relative to the other. Also, when the lever members telescope relative to each other, the L-shaped glide members permit smoother operation and they will wipe dirt off of the lever members as they move.

The glide members are made from a material which is abrasive resistant and has a low coefficient of friction. High density polyethylene has been found suitable. It will be understood that other materials could be used.

FIG. 6 shows an alternate type of uncoupling lever assembly. This assembly has a first rod 40, a second rod 42 each with stops 44 at one end. It will be understood that the other ends have a handle, lock lifter, and stops as in FIGS. 1 and 2. A central member 46 carries a plurality of sleeves 22, two of which extend in each direction to receive the rods 40 and 42. Each of the sleeves is lined with a pair of glide members 30 as described in the previous embodiment.

Whereas a preferred form of the invention has been shown and described, it will be understood that there may be alterations therein without departing from the scope of the following claims.

I claim:

1. An uncoupling lever assembly for a railroad car, comprising first and second lever members, a plurality of sleeves attached to one of the lever members, the other lever member extending through the sleeves in telescoping relation to said one lever member, and a pair of generally L-shaped glide members disposed directly opposite one another and lining each sleeve, each glide member having a base engaging a portion of the sleeve and a leg extending from the base, the leg lying next to an adjacent portion of the sleeve, the base and leg of the glide members being sized such that there are gaps between the base of one glide member and the leg of the other glide member of a pair.

2. The structure of claim 1 wherein the glide members further comprise a pair of flexible hooks connected to the base for engaging the sleeve.

3. An uncoupling lever assembly for a railroad car, comprising first and second lever members, a central member, a plurality of sleeves attached to the central member, the first and second lever members extending through the sleeves in telescoping relation, and a pair of generally L-shaped glide members disposed directly opposite one another and lining each sleeve, each glide member having a base engaging a portion of the sleeve and a leg extending from the base, the leg lying next to an adjacent portion of the sleeve, the base and leg of the glide members being sized such that there are gaps between the base of one glide member and the leg of the other glide member of a pair.

4. In an uncoupler lever assembly for a railroad car, first and second lever members, and a plurality of sleeves holding the lever members in telescoping relation, the improvement comprising a pair of generally L-shaped glide members disposed directly opposite one another and lining each sleeve, each glide member having a base engaging a portion of the sleeve and a leg extending from the base, the leg lying next to an adjacent portion of the sleeve, the base and leg of the glide members being sized such that there are gaps between the base of one glide member and the leg of the other glide member of a pair.

5. The structure of claim 4 wherein the glide members further comprise a pair of flexible hooks connected to the base for engaging the sleeve.

* * * * *